United States Patent [19]

Schank

[11] 4,439,509

[45] Mar. 27, 1984

[54] PROCESS FOR PREPARING OVERCOATED ELECTROPHOTOGRAPHIC IMAGING MEMBERS

[75] Inventor: Richard L. Schank, Webster, N.Y.

[73] Assignee: Xerox Corporation, Stamford, Conn.

[21] Appl. No.: 383,870

[22] Filed: Jun. 1, 1982

[51] Int. Cl.[3] ..... G03G 5/04

[52] U.S. Cl. ..... 430/132; 430/67

[58] Field of Search ..... 430/67, 132; 428/412, 428/447

[56] References Cited

U.S. PATENT DOCUMENTS

| | | | |
|---|---|---|---|
| 3,312,548 | 4/1967 | Straughan | 96/1.5 |
| 3,707,397 | 12/1972 | Gagnon | 117/72 |
| 3,753,709 | 8/1973 | Staudemmayer et al. | 96/1.5 |
| 3,775,115 | 11/1973 | Sorkin et al. | 96/33 |
| 3,816,915 | 1/1975 | Cawley | 96/1.5 |
| 3,865,588 | 2/1975 | Ohto et al. | 96/33 |
| 3,884,689 | 5/1975 | Limburg | 96/1.5 |
| 3,886,865 | 6/1975 | Ohto et al. | 101/456 |
| 3,953,206 | 4/1976 | Weigl | 96/1 LY |
| 3,986,997 | 10/1976 | Clark | 260/29.2 M |
| 4,006,020 | 2/1977 | Polastri | 96/1.5 |
| 4,006,271 | 2/1977 | French et al. | 427/164 |
| 4,009,032 | 2/1977 | Schank | 96/33 |
| 4,027,073 | 5/1977 | Clark | 428/412 |
| 4,062,681 | 12/1977 | Lewis et al. | 96/1.5 N |
| 4,148,637 | 4/1979 | Kubota et al. | 96/1.5 N |
| 4,181,526 | 1/1980 | Blakey et al. | 430/67 |
| 4,181,772 | 1/1980 | Chu et al. | 430/58 |
| 4,251,612 | 2/1981 | Chu et al. | 430/59 |
| 4,265,990 | 5/1981 | Stolka et al. | 430/59 |

*Primary Examiner*—John E. Kittle
*Assistant Examiner*—John L. Goodrow
*Attorney, Agent, or Firm*—Peter H. Kondo; John E. Beck; Ronald Zibelli

[57] ABSTRACT

A process for forming an overcoated electrophotographic imaging member by applying a coating of a cross-linkage siloxanol-colloidal silica hybrid material on an electrophotographic imaging member and thereafter contacting the coating with a fugitive ammonia gas condensation catalyst until the siloxanol-colloidal silica hybrid material forms a cross-linked solid layer. The cross-linkable siloxanol-colloidal silica hybrid material may be prepared by hydrolyzing trifunctional organosilanes and stabilizing the hydrolyzed silanes with colloidal silica. The electrophotographic imaging member may comprise inorganic or organic photoconductive components in one or more layers.

11 Claims, No Drawings

PROCESS FOR PREPARING OVERCOATED ELECTROPHOTOGRAPHIC IMAGING MEMBERS

BACKGROUND OF THE INVENTION

This invention relates to a process for preparing overcoated electrophotographic imaging members and more particularly, to a process of preparing electrophotographic imaging members overcoated with a solid cross-linked organosiloxane colloidal silica hybrid polymer.

The formation and development of electrostatic latent images utilizing electrophotographic imaging members is well known. One of the most widely used processes being xerography as described by Carlson in U.S. Pat. No. 2,297,691. In this process, an electrostatic latent image formed on an electrophotographic imaging member is developed by applying electroscopic toner particles thereto to form a visible toner image corresponding to the electrostatic latent image. Development may be effected by numerous known techniques including cascade development, powder cloud development, magnetic brush development, liquid development and the like. The deposited toner image is normally transferred to a receiving member such as paper.

There has recently been developed for use in xerographic imaging systems and for use in imaging systems utilizing a double charging process as explained hereinafter, overcoated organic imaging members including layered organic and layered inorganic photoresponsive devices. In one such photoresponsive device, a substrate is overcoated with a hole injecting layer, which in turn is overcoated with a hole transport layer, followed by an overcoating of a hole generating layer, and an insulating organic resin overcoating as a top coating. These devices have been found to be very useful in imaging systems, and have the advantage that high quality images are obtained, with the overcoating acting primarily as a protectant. The details of this type of overcoated photoreceptor are fully disclosed by Chu et al in U.S. Pat. No. 4,251,612. Similar multilayer photoreceptors are described, for example, in U.S. Pat. No. 4,265,990. The entire disclosures of these two patents are incorporated herein by reference.

Other photoreceptors that may utilize protective overcoatings include inorganic photoreceptors such as the selenium alloy photoreceptors, disclosed in U.S. Pat. No. 3,312,548, the entire disclosure of which is incorporated herein by reference.

When utilizing such an organic or inorganic photoresponsive device in different imaging systems, various environmental conditions detrimental to the performance and life of the photoreceptor from both a physical and chemical contamination viewpoint can be encountered. For example, organic amines, mercury vapor, human fingerprints, high temperatures and the like can cause crystallization of amorphous selenium photoreceptors thereby resulting in undesirable copy quality and image deletion. Further, physical damage such as scratches on both organic and inorganic photoresponsive devices can result in unwanted printout on the final copy. In addition, organic photoresponsive devices sensitive to oxidation amplified by electric charging devices can experience reduced useful life in a machine environment. Also, with certain overcoated organic photoreceptors, difficulties have been encountered with regard to the formation and transfer of developed toner images. For example, toner materials often do not release sufficiently from a photoresponsive surface during transfer or cleaning thereby forming unwanted residual toner particles thereon. These unwanted toner particles are subsequently embedded into or transferred from the imaging surface in subsequent imaging steps, thereby resulting in undesirable images of low quality and/or high background. In some instances, the dry toner particles also adhere to the imaging member and cause printout of background areas due to the adhesive attraction of the toner particles to the photoreceptor surface. This can be particularly troublesome when elastomeric polymers or resins are employed as photoreceptor overcoatings. For example, low molecular weight silicone components in protective overcoatings can migrate to the outer surface of the overcoating and act as an adhesive for dry toner particles brought into contact therewith in the background areas of the photoreceptor during xerographic development. These toner deposits result in high background prints.

When silicone protective overcoatings such as polysiloxane resins are used on selenium photoreceptors, particularly photoreceptors having low arsenic content, undesirable crystallization of the vitreous selenium can occur. This crystallization may result from the elevated temperatures used to cure the coating. When room temperature curing catalysts are used for curing silicones such as organic amine catalysts, the presence of the catalysts in the overcoating can crystallize the vitreous selenium over a period of time.

Moreover, catalysts in silicone overcoatings for photoreceptors having charge transport and charge generating layers often cause degradation of the photoreceptor. For example, organic amine catalysts having a solvating effect on polycarbonate binders for photoreceptors which in turn causes penetration into the binder layer with undesirable degradation of the photoconductive properties.

Further, silicone overcoatings, particularly those that cure at room temperature, often require long curing times of about 48 hours or longer. Long curing times adversely affect productivity and prolongs the period during which the overcoating is sensitive to physical and chemical damage.

SUMMARY OF THE INVENTION

It is a feature of the present invention to provide improved overcoated electrophotographic imaging members which overcome many of the abovenoted disadvantages.

Another feature of the present invention is to provide a more rapid process for forming a coating on electrophotographic imaging members at ambient temperature.

A further feature of the present invention is to provide a cured silicone overcoating for electrophotographic imaging members which does not degrade the imaging member during or subsequent to curing.

It is another feature of the present invention to provide an overcoating which permits excellent release and transfer of toner particles from an electrophotographic imaging member.

These and other features of the present invention are accomplished by coating an electrophotographic imaging member with a cross-linkable siloxanol-colloidal silica hybrid material and thereafter cross-linking the coating with ammonia gas to form a solid cross-linked polymer coating.

Examples of cross-linkable siloxanol-colloidal silica hybrid materials that are useful in the present invention include those materials commercially available from Dow Corning, such as Vestar Q9-6503 and from General Electric such as SHC-1000, SHC-1010, and the like. These cross-linkable siloxanol-colloidal silica hybrid materials have been characterized as a dispersion of colloidal silica and a partial condensate of a silanol in an alcohol-water medium.

These cross-linkable siloxanol-colloidal silica hybrid materials are believed to be prepared from trifunctional polymerizable silanes preferably having the structural formula:

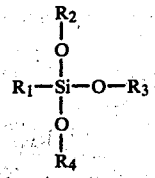

wherein $R_1$ is an alkyl or allene group having 1 to 8 carbon atoms, and $R_2$, $R_3$ and $R_4$ are independently selected from the group consisting of methyl and ethyl.

The OR groups of the trifunctional polymerizable silane are hydrolyzed with water and the hydrolyzed material is stabilized with colloidal silica, alcohol, and acid to maintain the pH at about 3 to 6. At least some of the alcohol may be provided from the hydrolysis of the alkoxy groups of the silane. The stabilized material is partially polymerized as a pre-polymer prior to application as a coating on an electrophotographic imaging member. The degree of polymerization should be sufficiently low with sufficient silicon bonded hydroxyl groups so that the organosiloxane prepolymer may be applied in liquid form with or without a solvent to the electrophotographic imaging member. Generally, this prepolymer can be characterized as a siloxanol polymer having at least one silicon-bonded hydroxyl group per every three —SiO— units. Typical trifunctional polymerizable silanes include methyl triethoxy silane, methyl trimethoxy silane, vinyl triethoxy silane, vinyl trimethoxy silane, vinyl triethoxy silane, butyl triethoxy silane, propyl trimethoxy silane, phenyl triethoxy silane and the like. If desired, mixtures of trifunctional silanes may be employed to form the cross-linkable siloxanol-colloidal silica hybrid. Methyl trialkoxy silanes are preferred because polymerized coatings formed therefrom are more durable and are more abhesive to toner particles.

The silica component of the coating mixture is present as colloidal silica. The colloidal silica is available in aqueous dispersions in which the particle size is between about 5 and about 150 millimicrons in diameter. Colloidal silica particles having an average particle size between about 10 and about 30 millimicrons provide coatings with the greatest stability. An example of a method of preparing the cross-linkable siloxanol-colloidal silica hybrid material employed in the coating process of this invention is described in U.S. Pat. Nos. 3,986,997 and 4,027,073, the entire disclosure of each patent being incorporated by reference herein. During coating of the cross-linkable siloxanol, i.e. partial condensate of a silanol, the residual hydroxyl groups condense to form a silsesquioxane, $RSiO_{3/2}$.

Since low molecular weight non-reactive oils are generally undesirable in the final overcoating, any such non-reactive oils should be removed prior to application to the electrophotographic imaging member. For example, linear polysiloxane oils tend to leach to the surface of solidified overcoatings and cause undesirable toner adhesion. Any suitable technique such as distillation may be employed to remove the undesirable impurities. However, if the stating monomers are pure, non-reactive oils are not present in the coating. Minor amounts of resins may be added to the coating mixture to enhance the electrical or physical properties of the overcoating. Examples of typical resins include polyurethanes, nylons, polyesters, and the like. Satisfactory results may be achieved when up to about 5 to 30 parts by weight of resin based on the total weight of the total coating mixture is added to the coating mixture prior to application to the electrophotographic imaging member.

The cross-linkable siloxanol-colloidal silica hybrid material of the present invention is applied to electrophotographic members as a thin coating having a thickness after cross-linking of from about 0.5 micron to about 5 microns. If coating thickness is increased above about 5 microns, mud cracking in the coating is likely to be encountered and the thicker coating is more difficult to cure. Thicknesses less than about 0.5 microns are difficult to apply but may probably be applied with spraying techniques. Generally speaking, a thicker coating tends to wear better. Moreover, deeper scratches are tolerated with thicker coatings because the scratches do not print out as long as the surface of the electrophotographic imaging member itself is not contacted by the means causing the scratch. A cross-linked coating having a thickness from about 0.5 micron to about 2 microns is preferred from the veiwpoint of optimizing electrical, transfer, cleaning and scratch resistance properties. These coatings also protect the photoreceptor from varying atmospheric conditions and can even tolerate contact with human hands.

The ammonia gas condensation catalyst is contacted with the outer surface of the applied cross-linkable siloxanol-colloidal silica hybrid material. Since the coating of cross-linkable silica hybrid material functions as a barrier between the ammonia gas condensation catalyst and the underlying electrophotographic imaging member, adverse effects resulting from the use of ammonia gas condensation catalyst are avoided. Moreover, the ammonia gas condensation catalyst is a fugitive material and does not remain in the overcoating after the organosiloxane-colloidal silica hybrid material is sufficiently cross-linked. When the overcoating is adequately cross-linked, it forms a hard, solid coating which is not dissolved by acetone. The cross-linked coating is exceptionally hard and resists scratching by a sharpened 5H or 6H pencil. While conventional room temperature curing organosiloxane coatings often require about 48 hours to cure, curing with the ammonia gas condensation catalyst is surprisingly rapid and can be effected, for example, in one and one-half hours at room temperature. Although elevated curing temperatures may be utilized, such higher temperatures should be avoided when coating temperature sensitive electrophotographic imaging members. Satisfactory curing temperatures include from about 18° C. to about 40° C.

The cross-linkable siloxanol-colloidal silica hybrid material may be applied to the electrophotographic imaging member by any suitable technique. Typical coating techniques include blade coating, dip coating, flow coating, spraying and draw bar processes. Any suitable solvent or solvent mixture may be utilized to facilitate forming the desired coating film thickness. Alcohols such as methanol, ethanol, propanol, isopropanol and the like can be employed with excellent results for both organic and inorganic electrophotographic imaging members.

Any suitable electrophotographic imaging member may be coated with the process of this invention. The electrophotographic imaging members may contain inorganic or organic photoresponsive materials in one or more layers. Typical photoresponsive materials include selenium, selenium alloys, such as arsenic selenium and tellurium selenium alloys, halogen doped selenium, and halogen doped selenium alloys. Typical multi-layered photoresponsive devices include those described in U.S. Pat. No. 4,251,612, which device comprising an electrically conductive substrate, overcoated with a layer capable of injecting holes into a layer on its surface, this layer comprising carbon black or graphite dispersed in the polymer, a hole transport layer in operative contact with the layer of hole injecting material, overcoated with a layer of charge generating material comprising inorganic or organic photoconductive materials, this layer being in contact with a charge transport layer, and a top layer of an insulating organic resin overlying the layer of charge generating layer. Other organic photoresponsive devices embraced within the scope of the present invention include those comprising a substrate, a generating layer such as trigonal selenium or vanadyl phthalocyanine in a binder, and a transport layer such as those described in U.S. Pat. No. 4,265,990.

The electrophotographic imaging member may be of any suitable configuration. Typical configurations include sheets, webs, flexible or rigid cylinders, and the like. Generally, the electrophotographic imaging members comprise a supporting substrate which may be electrically insulating, electrically conductive, opaque or substantially transparent. If the substrate is electrically insulating, an electrically conductive layer is usually applied to the substrate. The conductive substrate or conductive layer may comprise any suitable material such as aluminum, nickel, brass, conductive particles in a binder, and the like. For flexible substrates, one may utilize any suitable conventional substrate such as aluminized Mylar. Depending upon the degree of flexibility desired, the substrate layer may be of any desired thickness. A typical thickness for a flexible substrate is from about 3 mils to about 10 mils.

Generally, electrophotographic imaging members comprise one or more additional layers on the conductive substrate or conductive layer. For example, depending upon flexibility requirements and adhesive properties of subsequent layers, one may utilize an adhesive layer. Adhesive layers are well known and examples of typical adhesive layers are described in U.S. Pat. No. 4,265,990.

One or more additional layers may be applied to the conductive or adhesive layer. When one desires a hole injecting conductive layer coated on a substrate, any suitable material capable of injecting charge carriers under the influence of an electric field may be utilized. Typical of such materials include gold, graphite or carbon black. Generally, the carbon black or graphite dispersed in the resin are employed. This conductive layer may be prepared, for example, by solution casting of a mixture of carbon black or graphite dispersed in an adhesive polymer solution onto a support substrate such as Mylar or aluminized Mylar. Typical examples of resins for dispersing carbon black or graphite include polyesters such as PE 100 commercially available from GoodYear Company, polymeric esterification products of a dicarboxylic acid and a diol comprising a diphenol, such as 2,2-bis(3-beta hydroxy ethoxy phenyl)propane, 2,2-bis(4-hydroxyisopropoxyphenyl)propane, 2,2-bis(4-beta hydroxy ethoxy phenyl) pentane and the like and a dicarboxylic acid such as oxalic acid, malonic acid, succinic acid, phthalic acid, terephthalic acid, and the like. The weight ratio of polymer to carbon black or graphite may range from about 0.5:1 to 2:1 with the preferred range being about 6:5. The hole injecting layer may have a thickness in the range of from about 1 micron to about 20 microns, and preferably from about 4 microns to about 10 microns.

A charge carrier transport layer may be overcoated on the hole injecting layer and may be selected from numerous suitable materials capable of transporting holes. The charge transport layer generally has a thickness in the range of from about 5 to about 50 microns and preferably from about 20 to about 40 microns. A charge carrier transport layer preferably comprises molecules of the formula:

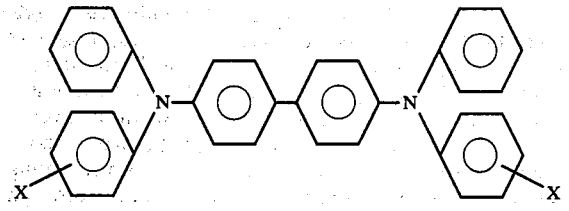

dispersed in a highly insulating and transparent organic resinous material wherein X is selected from the group consisting of (ortho) $CH_3$, (meta) $CH_3$, (para) $CH_3$, (ortho) Cl, (meta) Cl, and (para) Cl. The charge transport layer is substantially non-absorbing in the spectral region of intended use, e.g., visible light, but is "active" in that it allows injection of photogenerated holes from the charge generator layer and electrically induced holes from the injecting surface. A highly insulating resin, having a resistivity of at least about $10^{12}$ ohm-cm to prevent undue dark decay will not necessarily be capable of supporting the injection of holes from the injecting generating layer and is not normally capable of allowing the transport of these holes through the resin. However, the resin becomes electrically active when it contains from about 10 to about 75 weight percent of, for example, N,N,N',N'-tetraphenyl-[1,1'-biphenyl]-4,4'-diamine corresponding to the structural formula above. Other materials corresponding to this formula include, for examples, N,N'-diphenyl-N,N'-bis-(alkylphenyl)-[1,1'-biphenyl]-4,4'-diamine wherein the alkyl group is selected from the group consisting of methyl such as 2-methyl, 3-methyl and 4-methyl, ethyl, propyl, butyl, hexyl, and the like. In the case of chloro substitution, the compound may be N,N'-diphenyl-N,N'-bis(halophenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes includes triphenylmethane, bis(4-diethylamino-2-methylphenyl) phenylmethane, 4',4''-bis(diethylamino)-2',2''-dimethyltriphenyl methane, bis-4(diethylaminophenyl) phenylmethane, and 4,4'-bis(diethylamino)-2',2''-dimethyltriphenyl methane.

The generating layer that may be utilized, in addition to those disclosed herein, can include, for example, pyrylium dyes, and numerous other photoconductive charge carrier generating materials provided that these materials are electrically compatible with the charge carrier transport layer, that is, they can inject photoexcited charge carriers into the transport layer and the charge carriers can travel in both directions across the interface between the two layers. Particularly useful inorganic photoconductive charge generating material include amorphous selenium, trigonal selenium, selenium-arsenic alloys and selenium-tellurium alloys and organic charge carrier generating materials including the X-form of phthalocyanine, metal phthalocyanines and vanadyl phthalocyanines. These materials can be used alone or as a dispersion in a polymeric binder. This layer is typically from about 0.5 to about 10 microns or more in thickness. Generally, the thickness of the layer should be sufficient to absorb at least about 90 percent or more of the incident radiation which is directed upon it in the imagewise exposure step. The maximum thickness is dependent primarily upon mechanical considerations such as whether a flexible photoreceptor is desired.

The electrically insulating layer typically has a bulk resistivity of from about $10^{12}$ to about $5\times10^{14}$ ohm-cm, and typically is from about 5 to about 25 microns in thickness. Generally, this layer can also function as a protectant in that the charge carrier generator layer is kept from being contacted by toner particles and ozone generated during the imaging cycles. The overcoating layer, also prevent charges from penetrating through the overcoating layer into the charge carrier generating layer or from being injected into it by the latter. Therefore, insulating overcoating layers comprising materials having higher bulk resistivities are preferred. Generally, the minimum thickness of the layer is determined by the electrical functions the layer must provide whereas the maximum thickness is determined by both mechanical considerations and the resolution capability desired for the photoreceptor. Suitable overcoating materials include Mylar (a polyethylene terephthalate film available from E. I. duPont deNemours), polyethylenes, polycarbonates, polystyrenes, acrylics, epoxies, phenolics, polyesters, polyurethanes, and the like. These overcoating materials may also serve as a primer layer between an organic or inorganic photoconductor structure and the cross-linked organosiloxane-silica hybrid coating of this invention. Such primer coatings are particularly desirable for selenium photoreceptors.

In one imaging sequence, the five layered overcoated electrophotographic imaging member described hereinabove and containing as a top layer the cross-linked organosiloxane-silica hybrid polymer described herein is initially electrically charged negatively in the absence of illumination resulting in negative charges residing on the surface of the electrically insulating overcoating layer. This causes an electric field to be established across the photoreceptor device and holes to be injected from the charge carrier injecting electrode layer into the charge carrier transport layer, which holes are transported through the layer and into the charge carrier generating layer. These holes travel through the generating layer until they reach the interface between the charge carrier generator layer and the electrically insulating overcoating layer where such charges become trapped. As a result of this trapping at the interface, there is established an electrical field across the electrically insulating overcoating layer. Generally, this charging step is accomplished within the range of from about 10 volts/micron to about 100 volts/micron.

The device is subsequently charged a second charge in the absence of illumination but with a polarity opposite to that used in the first charging step, thereby substantially neutralizing the negative charges residing on the surface. After the second charging step with a positive polarity, the surface is substantially free of electrical charges, that is, the voltage across the photoreceptor member upon illumination is brought to substantially zero. As a result of the charging step, positive charges reside at the interface between the generating layer and the overcoating layer and further, there is a uniform charge of negative charges located at the interface between the hole injecting layer and the transport layer.

Thereafter, the electrophotographic imaging member can be exposed to an imagewise pattern of electromagnetic radiation to which the charge carrier generating layer is responsive to form an electrostatic latent image on the electrophotographic imaging member. The electrostatic latent image formed may then be developed by conventional means resulting in a visible image. Conventional development techniques such as cascade development, magnetic brush development, liquid development, and the like may be utilized. The visible image is typically transferred to a receiving member by conventional transfer techniques and permanently affixed to the receiving member.

The cross-linkable siloxanol-colloidal silica hybrid materials of the present invention can also be used as overcoatings for three layered organic electrophotographic imaging members as indicated hereinabove and in the Examples below. For example, in U.S. Pat. No. 4,265,990, an electrophotographic imaging device is described which comprises a substrate, a generating layer, and a transport layer. Examples of generating layers include trigonal selenium and vanadyl phthalocyanine. Examples of transport layers include various diamines dispersed in a polymer as disclosed hereinabove and in the Examples below.

The cross-linkable siloxanol-colloidal silica hybrid materials of the instant invention are soluble in solvents such as alcohol and thus can be conveniently coated from alcoholic solutions. However, once the organosiloxane-silica hybrid material is cross-linked into its resinous state, it is no longer soluble and can withstand cleaning solutions such as ethanol. Additionally, because of their excellent transfer and cleaning characteristics, the overcoated electrophotographic imaging devices of the present invention may be utilized in liquid development systems. Moreover, inorganic or organic electrophotographic imaging devices coated with the cross-linked organosiloxane-silica hybrid polymers of the present invention are resistant to the effects of humidity. Since the ammonia gas condensation catalyst does not remain in the overcoating and since the catalyst does not contact the layer underlying the overcoating of the present invention during the curing step, it does not cause degradation of the photoconductive properties of the underlying layers as do many non-fugitive catalysts.

The invention will now be described in detail with respect to specific preferred embodiments thereof, it being understood that these embodiments are intended to be illustrative only and that the invention is not intended to be limited to the specific materials, conditions, process parameters and the like recited herein. Parts and percentages are by weight unless otherwise indicated. Ambient temperature ranged from about 18° C. to about 24° C.

EXAMPLE I

A control experiment was conducted with a multilayer electrophotographic imaging member comprising an aluminized Mylar substrate having a thickness of about 5 mils, overcoated with a generating layer of trigonal selenium in polyvinylcarbazole, having a thickness of about 2 microns, overcoated with a transport layer of N,N'-diphenyl-N-N'-bis(methylphenyl)-[1,1'-biphenyl]-4,4'-diamine dispersed in polycarbonate resin having a thickness of about 27 microns. This imaging member was overcoated with a film of cross-linkable siloxanol-colloidal silica hybrid material commercially available from Dow Corning Company as VESTAR, Q-9, containing 7.5 percent solids in a methanol/isopropanol mixture. The cross-linkable organosiloxane-silica hybrid material solution also contained 3 percent by weight of potassium acetate which functions as a high temperature cross-linking (curing) catalyst for the organosiloxane-silica hybrid material. The film was applied by flow coating over the electrophotrographic imaging member. The resulting coating required thermal curing for 3 hours at 85° C. to form a final cross-linked organosiloxane-silica hybrid polymer solid coating having a thickness of about 2 microns. Similarly, curing of identical coatings were also carried out at about 110° C. to about 120° C. for 30 minutes.

EXAMPLE II

Another control experiment was conducted with a multi-layer electrophotographic imaging member having the structure described in Example I. An overcoating containing the composition described in Example I is applied by using a #8 Mayer rod. After air drying, the sample was stored at ambient temperature for 24 hours. No sign of cross-linking was evident. The film was sticky to the touch, and could be easily removed with either alcohol or acetone from the multi-layer electrophotographic imaging member surface.

EXAMPLE III

The procedure described in Example I was repeated except that the potassium acetate catalyst was not used to cross-link the siloxanol-colloidal silica hybrid material. Instead cross-linking was effected by exposing the exposed surface of the organosiloxane-silica hybrid material coating with ammonia vapor in a chamber over concentrated ammonium hydroxide for about 45–60 minutes at 20° C. The resulting hard cross-linked organosiloxane-silica hybrid polymer solid coating was completely resistant to rubbing by an acetone saturated Q-tip indicating that curing had taken place.

In comparing the coating process of this example with that of Examples I and II, it is apparent that cross-linking of the organosiloxane-silica hybrid material may be effected at significantly higher rates and lower temperatures.

Electrical scanning measurements on the sample of the instant example indicated a residual voltage equivalent to that obtained by the thermal and non-fugitive curing catalyst of Example I. This residual voltage is evidence of the removal of polar hydroxyl cure sites present in the overcoating necessary to achieve cross-linking of the polymer structure. Unreacted hydroxyl groups apparently function as conductive cites and leak off the voltage resulting in little or no observed residual. Moreover, it was surprising that the overcoated polycarbonate layer was not adversely affected by the ammonia vapor exposure step. Without the overcoating present, polycarbonates normally degrade in the presence of reagents having the base strength of ammonia and greater.

EXAMPLE IV

An electrophotographic imaging member having the layers identical to those described in Example I, (other than the overcoating) was coated with an acrylic primer polymer available from General Electric Company as SHP-200 as a 4 percent by weight solid mixture using a #3 Mayer rod.

The primer coating was air dried for 30 minutes at ambient temperatures to form a layer having a thickness between about 0.1 to 0.3 microns. An overcoating containing a cross-linkable organosiloxane-silica hybrid material available from General Electric Company as SHC-1010 containing 20 percent by weight solids is applied to the dried primer coat using a #3 Mayer rod. The deposited coating was air dried for 30 minutes at ambient temperature. An exposed section of the surface of the deposited coating was contacted with ammonia vapor in a chamber over concentrated ammonium hydroxide for 45 minutes at ambient temperature. The resulting solid cross-linked organosiloxane-silica hybrid material coating was hard and completely resistant to rubbing by an acetone saturated Q-tip indicating that a cure had taken place. Flat plate electrical scanning measurements on this sample indicated a residual voltage equivalent to that obtained by thermal curing of an untreated exposed section of the same overcoated photoreceptor. This residual voltage is evidence of the removal of polar hydroxyl cure sites present in the system necessary to achieve cross-linking of the polymer structure.

Again, as with the overcoating utilized in Example III, the polycarbonate layer of the electrophotographic imaging member of this Example was not adversely affected by ammonia vapor due to the barrier effect of the overcoating. As indicated in Example III, polycarbonates normally degrade in the presence of reagents having a base strength of ammonia and greater.

EXAMPLE V

An electrophotographic imaging member comprising an aluminum drum coated with an arsenic-selenium alloy doped with chlorine is coated by flow coating an acrylic polymer available from General Electric Company as SHP-200 as a 2 percent by weight solid mixture. The coating is thoroughly air dried to form a primer layer. An automatic commercial spray gun is then employed to apply a cross-linkable siloxanol-colloidal silica hybrid material available from General Electric Company as SHC-1010 containing 20 weight percent TPU-123 polyurethane available from Goodyear Chemical Co., (10 weight percent solids overall) to form an overcoating. This overcoating is air dried thoroughly. The entire coated drum is then exposed to anhydrous ammonia vapor in a chamber over concentrated ammonium hydroxide for 45 minutes at ambient temperature to form a final cured coating having a thickness of 1.75 microns.

Subsequent electrical abrasion testing to simulate 50,000 copy cycles in a Xerox 3100 machine verified that cross-linking of the coating had taken place. Transmission electron micrographs of portions of the drum both before and after the abrasion test indicated little or no wear had taken place.

EXAMPLE VI

A coating of an acrylic primer polymer available from General Electric as SHP-100 having a 4 percent solids content was coated onto two 3 inch by 3 inch grained aluminum plates using a #3 Mayer rod. The resulting coating was dried and cured for 30 minutes at about 120° C. in an air oven. A cross-linkable siloxanol-colloidal silica hybrid material available from General Electric as SHC-1010 supplied as a 10 percent solids mixture and containing a sodium acetate catalyst effective at temperatures above about 80° C., was applied as a coating on one of the plates using a #14 Mayer rod. The coated plate was then air dried for 30 minutes at about 120° C. in an air oven. The cured cross-linked organosiloxane-silica solid polymer coating could not be scratched with a sharpened 5H pencil.

A second primed aluminum plate was overcoated with the cross-linkable organosiloxane-silica hybrid material as described in the preceding paragraph, but instead of air drying, the coated plate was exposed to ammonium vapor in a chamber over ammonium hydroxide for about 30 minutes at 22°–23° C. This sample could also not be scratched with a sharpened 5H pencil, thus indicating a cross-linking cure equal to that achieved with air oven drying had occurred.

EXAMPLE VII

The procedure described in Example I was repeated except that the potassium acetate catalyst was not used. Cross-linking of the organosiloxane-silica hybrid material was effected by exposing the exposed surface of the organosiloxane-silica hybrid material coating with anhydrous ammonia vapor in a chamber for about 30 minutes at ambient temperature. The resulting hard cross-linked organosiloxane-silica hybrid polymer coating was completely resistant to rubbing by an acetone saturated Q-tip indicating that curing had taken place.

In comparing the results of the coating process of this example with that of Examples I and II, it is apparent that cross-linking of the organosiloxane-silica hybrid material may be effected at significantly higher rates and lower temperatures.

Electrical scanning measurements on the sample of the instant example indicated a residual voltage equivalent to that obtained by a thermal and non-fugitive curing catalyst of Example I. This residual voltage is evidence of the removal of polar hydroxyl curesites present in the overcoating necessary to achieve cross-linking of the polymer structure.

EXAMPLE VIII

An electrophotographic imaging member comprising an aluminum drum coated with an arsenic-selenium alloy doped with chlorine was coated by flow coating an acrylic polymer available from General Electric Company as SHP-200 as a 2 percent by weight solid mixture. The coating is thoroughly air dried to form a primer layer. An automatic commercial spray gun is then employed to apply a cross-linkable siloxanol-colloidal silica hybrid material available from Dow Corning as VESTAR Q-9 containing 20 weight percent TPU-123 polyurethane (4 weight percent solids overall) to form an overcoating. This overcoating was air dried thoroughly. The entire coated drum is then exposed to anhydrous ammonia vapor in a chamber for 45 minutes at ambient temperature to cure to form a final coating having a thickness of 1.75 microns thick.

Subsequent electrical abrasion testing to simulate 50,000 copy cycles in a Xerox 3100 machine verified that cross-linking of the coating had taken place. Transmission electron micrographs (TEM) of portions of the drum both before and after the abrasion test indicated little or no wear had taken place.

The invention has been described in detail with particular reference to preferred embodiments thereof and it will be understood that variations and modifications can be effected within the spirit and scope of the invention as described hereinabove, and as defined in the appended claims.

I claim:

1. A process for forming an overcoated electrophotographic imaging member comprising the steps of providing an electrophotographic imaging member, applying a coating in liquid form of a cross-linkable siloxanol-colloidal silica hybrid material having at least one silicon bonded hydroxyl group per every three —SiO— units on said electrophotographic imaging member, and contacting said coating with an ammonia gas condensation catalyst until the siloxanol-colloidal silica hybrid material forms a hard cross-linked solid organosiloxane-silica hybrid polymer layer.

2. A process according to claim 1 wherein said cross-linked organosiloxane-silica hybrid polymer solid layer has a thickness of between about 0.5 micron and about 2 microns.

3. A process according to claim 1 wherein said coating is contacted with said ammonia gas condensation catalyst at about room temperature until said coating forms a cross-linked organosiloxane-silica hybrid polymer solid layer.

4. A process according to claim 1 including removing said ammonia gas condensation catalyst from said coating after said coating forms a cross-linked organosiloxane-silica hybrid polymer solid layer whereby said layer is substantially free of any ambient temperature curing catalyst.

5. A process according to claim 1 wherein said cross-linked organosiloxane-silica hybrid polymer layer is substantially free of difunctional silicone materials.

6. A process according to claim 1 wherein said ammonia gas condensation catalyst is contacted with said coating until said cross-linked organosiloxane polymer solid layer is substantially insoluble in acetone.

7. A process according to claim 1 wherein said coating is applied to an amorphous selenium layer of an electrophotographic imaging member.

8. A process according to claim 1 wherein said coating is applied to a selenium alloy layer of an electrophotographic imaging member.

9. A process according to claim 1 wherein said coating is applied to a charge generating layer of an electrophotographic imaging member.

10. A process according to claim 1 wherein said coating is applied to a charge transport layer of an electrophotographic imaging member.
11. A process according to claim 10 wherein said charge transport layer comprises a diamine dispersed in a polycarbonate resin, said diamine having the following formula:
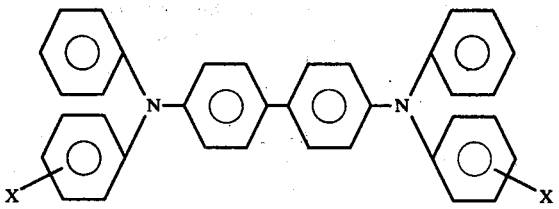
wherein X is selected from the group consisting of $CH_3$ and Cl.
* * * * *